United States Patent [19]

Atkielski

[11] Patent Number: 4,541,637

[45] Date of Patent: Sep. 17, 1985

[54] BOOMERANG

[76] Inventor: John Atkielski, 3542 N. Albany St., Chicago, Ill. 60618

[21] Appl. No.: 465,447

[22] Filed: Feb. 10, 1983

[51] Int. Cl.[4] ..... A63B 65/08

[52] U.S. Cl. ..... 273/426

[58] Field of Search ..... 273/426, 424, 425

[56] References Cited

U.S. PATENT DOCUMENTS

| | | | |
|---|---|---|---|
| 3,467,385 | 9/1969 | Liston | 273/426 |
| 3,710,505 | 1/1973 | Linenfelser | 273/424 X |
| 3,955,817 | 5/1976 | Davis | 273/425 |
| 4,196,540 | 4/1980 | Hembree et al. | 273/424 X |
| 4,222,573 | 9/1980 | Adler | 273/426 |

FOREIGN PATENT DOCUMENTS

| | | | |
|---|---|---|---|
| 1235113 | 5/1960 | France | 273/426 |
| 2262541 | 10/1975 | France | 273/426 |
| 2342756 | 9/1977 | France | 273/426 |
| 699214 | 11/1953 | United Kingdom | 273/426 |
| 718215 | 11/1954 | United Kingdom | 273/426 |

*Primary Examiner*—Paul E. Shapiro

*Attorney, Agent, or Firm*—Fitch, Even, Tabin & Flannery

[57] ABSTRACT

An improved boomerang is provided which returns approximately to the point from which it is thrown and which does not require a high degree of skill on the part of the user to be thrown properly. The boomerang has an integral, generally V-shaped body formed of two wings having upward longitudinal curvature so that the bottom wing surfaces define a curved surface rather than a substantially planar surface. The preferred boomerang is molded from a lightweight, resilient structural foam.

1 Claim, 4 Drawing Figures

G
H
R
A
B
C
D
E
F
N
10
12a
12b
14a
14b
16a,b
18a
18b
22a
22b
24a,b
26a
26b
27a,27b
28a
28b
29a
29b
30
32
34a,b
36a,b
38a
40

BOOMERANG

BACKGROUND OF THE INVENTION

The present invention relates generally to aerial toys and more particularly to a boomerang.

Various boomerang designs are presently manufactured for commercial sale. Boomerangs have generally V-shaped configurations and comprise two integrally connected elongated wings generally defining an included angle therebetween of approximately 90°. Heretofore, toy boomerangs have generally been made of wood and have had substantially planar bottom surfaces. Such boomerangs have generally been handmade and consequently have not been precisely balanced. Boomerangs of this type have not performed satisfactorily and have shown poor impact resistance.

A boomerang is thrown by imparting forward motion as well as spin to the boomerang. When thrown in a generally horizontal direction, the boomerang is intended to follow a curving trajectory through the air which ultimately returns the boomerang to the location from which it was thrown. Many commercially available boomerangs return to the proper location only when thrown in a precise manner requiring a high degree of skill which is beyond most users, while other boomerangs simply fail to return regardless of how they are thrown.

SUMMARY OF THE INVENTION

In accordance with the present invention, an improved boomerang is provided which has a high probability of returning to the point from which it is thrown and which does not require a high degree of skill on the part of the user. The boomerang has an integral, generally V-shaped body which defines two wings having upward longitudinal curvature so that the bottom wing surfaces define a curved surface rather than a substantially planar surface as found on prior boomerangs. The longitudinal curvature of the wings, in combination with the particular wing configurations, improves the performance of the boomerang in free flight and additionally enables it to "skip" or bounce off flat surfaces during flight.

In its preferred embodiment, the boomerang is molded from a lightweight, resilient structural foam material. Use of a molded construction rather than a conventional wooden construction provides an advantage in that selection of the configuration of the structure is not subject to the constraints of conventional woodworking processes. This permits the wing configurations to conform to relatively narrow tolerances and permits the boomerang to be balanced. In addition, the resiliency of the molded foam material makes the boomerang resistant to breakage and augments its ability to skip or bounce during flight.

Accordingly, a general object of the present invention is to provide a boomerang having a high probability of returning to the location from which it is thrown without requiring that it be thrown with a high degree of precision.

A more specific object of the present invention is to provide a lightweight, molded boomerang with longitudinally curved wings.

A further object of the present invention is to provide a boomerang which may be "skipped" or bounced off flat surfaces during flight.

Other objects and advantages of the invention will become apparent from the following detailed description and the accompanying drawing wherein like reference numerals designate like elements throughout the several views.

DETAILED DESCRIPTION OF THE PREFERRED EMBODIMENT

Figures 1, 2, 3, 4:
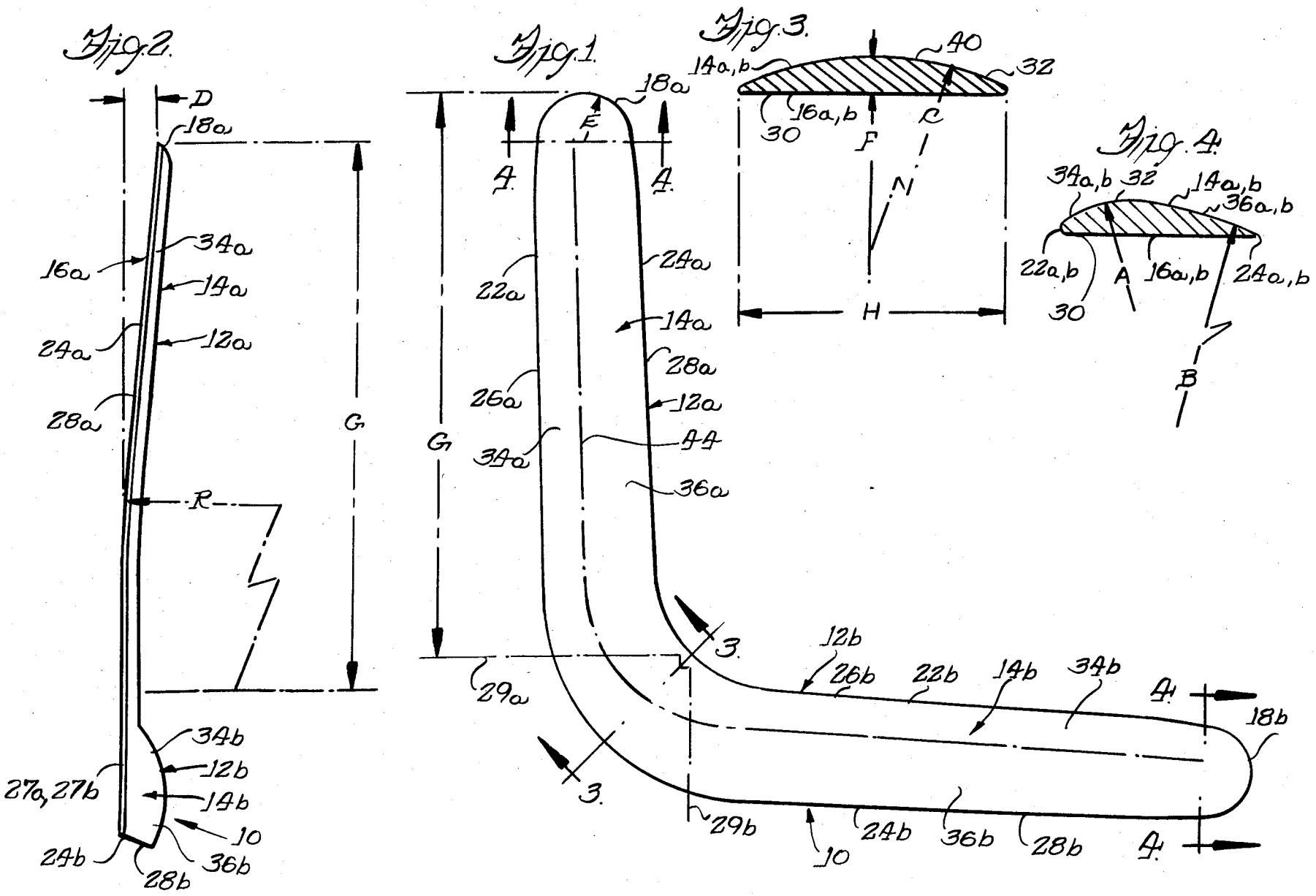
FIG. 1 is a plan view of a boomerang embodying the present invention.
FIG. 2 is a side elevational view of the boomerang of FIG. 1.
FIG. 3 is a transverse sectional view taken substantially along line 3—3 in FIG. 1 and looking in the direction of the arrows.
FIG. 4 is a transverse sectional view taken substantially along either of the lines designated 4—4 in FIG. 1 and looking in the direction of the arrows.

Referring now to the drawing, and more particularly to FIG. 1., the boomerang of the present invention has a generally V-shaped body 10 formed of a pair of wings 12*a* and 12*b* joined integrally at a common vertex through which is passed a substantially vertical transverse plane represented by line 3—3. Each wing 12*a*, 12*b* has an airfoil profile defined by an upper wing surface 14*a*, 14*b* and a lower wing surface 16*a*, 16*b*. For purposes of reference herein, the terms "upper" and "lower" refer to the boomerang as having a generally horizontal orientation as shown in the drawing. However, it should be understood that the boomerang changes orientation during flight and need not be horizontal when thrown, as explained in further detail below.

Each wing has a rounded end 18*a*, 18*b*. The wings are tapered, decreasing both in vertical thickness and in lateral width progressively from line 3—3 toward their outer ends.

Viewed in plan, the wings 12*a,b* appear symmetrical about line 3—3. Each wing has a leading edge 22*a*, 22*b* and a trailing edge 24*a*, 24*b*. Each of the leading edges has a relatively long linear portion 26*a*, 26*b*. Each of the trailing edges also has a relatively long linear portion 28*a*, 28*b*. The leading edge of each wing is contiguous to the trailing edge of the opposite wing. The linear portions 28*a* and 26*b* of the trailing edge 24*a* of wing 12*a* and the leading edge 22*b* of wing 12*b*, respectively, define an included angle therebetween of approximately 97°. The linear portions 26*a* and 28*b* of the leading edge 22*a* of wing 12*a* and the trailing edge 24*b* of wing 12*b*, respectively, define an included angle therebetween of approximately 93°.

Each wing 12*a*, 12*b* includes a relatively small planar surface area 27*a*, 27*b* on its lower surface 16*a*, 16*b* in the area defined between reference lines 29*a* and 29*b* in FIG. 1. In accordance with the present invention, the remaining portion of each wing, designated as the length G in FIGS. 1 and 2, has an upward longitudinal curvature. This curvature is substantially equal for both wings and is defined as the longitudinal radius of curvature of the corresponding lower wing surface 16*a*, 16*b*, as designated by the character "R" in FIG. 2. The lower wing surfaces 16*a*, 16*b* are elevated at the ends 18*a*, 18*b* of the wings 12*a*, 12*b* by a distance "D" with respect to the plane of the surface areas 27*a*, 27*b* due to the upward longitudinal curvature of the wings.

Referring to FIG. 4, each wing has a transverse cross-sectional configuration of an airfoil profile. While the transverse profile of each wing varies along the length of the wing, the upper surface of each wing 14*a,b* appears in any given transverse section as an arcuate surface line 32, and the lower surface 16*a,b* appears in any given transverse section as a straight surface line 30. The upper surface 14*a,b* of each wing is defined by a leading arcuate surface 34*a,b* and downwardly inclined trailing arcuate surface 36*a,b* which blends with the corresponding leading surface 34*a,b*. The leading arcuate surface 34*a,b* of each wing has a radius of curvature designated as "A" which varies along the length of the wing. The trailing surface 36 has a radius of transverse curvature designated as "B" which varies along the length of the wing. In the illustrated transverse section through either of lines 4—4, radius B is substantially greater than radius A. Proceeding along each wing from its outer end toward line 3—3, the values of the respective radii of transverse curvature A and B converge. In the illustrated transverse section through line 3—3 the configuration of the upper surface 14*a,b* is defined by a single radius of transverse curvature "C". Reference line 44 represents a line passing through the points of maximum thickness of the transverse airfoil profiles along substantially the full length of the boomerang body.

The dimensions of one example of a boomerang in accordance with the illustrated embodiment are as follows. As taken through transverse section lines 4—4, radius A is approximately 0.985 inches and radius B is approximately 5.0 inches. Proceeding along the wing to line 3—3, the values of A and B converge to C, which is approximately 2.66 inches. The radius of longitudinal curvature R of the bottom wing surfaces is approximately 100 inches.

The length G of the curved portion of each wing is approximately 9.12 inches, and D is approximately 0.584 inches. The radius of curvature E at the ends 18*a*, 18*b*, as viewed in plan is approximately 0.87 inches, while the maximum vertical thickness F of the boomerang, which occurs at the point where line 44 intersects transverse section line 3—3, is approximately 0.316 inch. The maximum width H of the boomerang, which occurs at line 3—3, is approximately 2.34 inch.

The above dimensions are given for illustrative purposes only. It will be appreciated that the boomerang may be made in various sizes and that the various parameters may be varied to change the flight characteristics of the boomerang. For example, while it is believed that the aforementioned longitudinal radius of curvature R of approximately 100 inches will provide a satisfactory flight path for the average user, decreasing the radius of longitudinal curvature will shorten the turning radius traversed by the boomerang as it travels through the air and returns to the thrower.

In operation the boomerang may be thrown in any of several different ways. One method is to throw the boomerang in a vertical orientation, grasping wing 12*b* near its outer end and using an overhand motion to throw the boomerang forward with a forward spin. When thrown in this manner, the boomerang returns to the user without striking the ground.

To "skip" the boomerang off a horizontal surface lower in elevation than the point from which the boomerang is thrown, the thrower orients the boomerang generally horizontally, gripping wing 12*b* and simultaneously imparting forward motion as well as spin to the boomerang while directing the boomerang slightly downwardly toward the lower horizontal surface. The lower surfaces 16*a,b* of the boomerang make momentary contact with the horizontal surface, and the boomerang then "skips" or bounces off the horizontal surface and continues its flight which ultimately returns it to the user.

To enable the boomerang to tolerate repeated uses without breaking, it is desirable that the boomerang be made of a durable, impact-resistant material. The impact-resistance of the material is particularly important where the boomerang is to be "skipped" or bounced off a hard surface. The material should be relatively stiff to prevent substantial deformation of the boomerang during flight and somewhat resilient to enable the boomerang to skip properly. A relatively light weight is desirable for aerodynamic considerations. Thus, the boomerang is preferably made of a lightweight, durable, impact-resistant material which is resilient and relatively stiff. One material which has been found satisfactory is UNION CARBIDE RIM 160 formed by reaction injection molding as a microcellular structural foam. This material is a high modulus urethane elastomer which may be formed at various densities. Densities from 27 to 36 lbs. per cubic foot have been found satisfactory. The preferred density is 35 lbs. per cubic foot.

Many known wooden boomerangs have substantially planar bottom surfaces and include substantially planar portions on their top surfaces formed to approximate a curved airfoil profile for each wing. It is difficult to form curved airfoil surfaces economically on wooden wings, and it is particularly difficult to form balanced wooden wings having a predetermined radius of longitudinal curvature. Because the boomerang of the present invention is molded rather than made of wood, the boomerang configuration has been selected for optimal performance without being limited by the constraints of woodworking processes. The airfoil profiles are characterized by smooth curves and the boomerang is balanced so that its mass is distributed equally about the vertical plane represented by line 3—3 in FIG. 1.

While a preferred embodiment of the present invention has been illustrated and described, it will be appreciated that various departures may be made from the specifications set forth herein without departing from the spirit and scope of the invention. The illustrated embodiment of the invention is intended for use by a right-handed user. The boomerang may, in the alternative, be made with a mirror image configuration to that illustrated for use by a left-handed user.

Various features of the invention are defined in the following claims.

What is claimed is:

1. A molded boomerang comprising:

first and second wings defining a generally V-shaped body, said wings being integrally joined at a common juncture and having rounded ends, each of said wings having upper and lower surfaces and having leading and trailing edges, the leading edge of said first wing being contiguous with the trailing edge of said second wing, the trailing edge of said first wing being contiguous with the leading edge of said second wing, each of said leading and trailing edges including a relatively long linear portion, the linear portion of the leading edge of said first wing and the linear portion of the trailing edge of said second wing defining an included angle of about 97°, the linear portion of the trailing edge of said first wing and the linear portion of the leading edge of said second wing defining an included angle of about 93°, each of said wings having a maximum horizontal width of about 2.3 inches and a maximum vertical thickness of about 0.32 inch, each of said wings being tapered to decrease progressively in thickness and in width toward its respective end, each of said lower wing surfaces having an upward longitudinal radius of curvature of about 100 inches, said upper and lower wing surfaces being configured to define an airfoil profile for each wing which varies in configuration along the length of the wing, each of said upper wing surfaces comprising a leading arcuate surface and a trailing arcuate surface blending with said leading arcuate surface, each of said arcuate surfaces having a radius of transverse curvature at any particular transverse section, the radius of transverse curvature of each of said leading arcuate surfaces varying from about 0.985 inch near the end of the wing to about 2.7 inches at the juncture of the wings, the radius of transverse curvature of each of said trailing arcuate surfaces varying from about 5.0 inches near the end of the wing to about 2.7 inches at the juncture of the wings, said lower wing surface having no transverse curvature.

* * * * *